US007607314B2

(12) United States Patent
Eisenhour

(10) Patent No.: US 7,607,314 B2
(45) Date of Patent: Oct. 27, 2009

(54) AIR CONDITIONING SYSTEM

(75) Inventor: Ronald S. Eisenhour, West Bloomfield, MI (US)

(73) Assignee: Nissan Technical Center North America, Inc., Farmington Hills, MI (US)

( * ) Notice: Subject to any disclaimer, the term of this patent is extended or adjusted under 35 U.S.C. 154(b) by 412 days.

(21) Appl. No.: 11/639,421

(22) Filed: Dec. 15, 2006

(65) Prior Publication Data

US 2008/0141705 A1 Jun. 19, 2008

(51) Int. Cl.
*F25B 41/00* (2006.01)

(52) U.S. Cl. ..... 62/197; 62/402

(58) Field of Classification Search ..... 62/172, 62/196.1, 197, 222–225, 402
See application file for complete search history.

(56) References Cited

U.S. PATENT DOCUMENTS 3,934,424 A * 1/1976 Goldsberry ..... 62/87
4,088,426 A 5/1978 Edwards
5,758,501 A 6/1998 Jirnov et al.
6,272,871 B1 8/2001 Eisenhour
6,655,165 B1 12/2003 Eisenhour
6,739,141 B1 5/2004 Sienel et al.
6,854,283 B2 * 2/2005 Nakatani et al. ..... 62/172
6,877,340 B2 * 4/2005 Hiwata et al. ..... 62/527
7,350,366 B2 * 4/2008 Yakumaru et al. ..... 62/116
2004/0074256 A1 4/2004 Hiwata et al.
2004/0216483 A1 * 11/2004 Inaba et al. ..... 62/498

* cited by examiner

*Primary Examiner*—William E Tapolcai
(74) *Attorney, Agent, or Firm*—Global IP Counselors, LLP

(57) ABSTRACT

An air conditioning system includes an evaporator, a compressor, a condenser, a valve an energy recovery device and at least one bypass passage. The compressor is fluidly connected to the evaporator. The condenser is fluidly connected to the compressor. The valve is configured to control flow of high-pressure refrigerant exiting the condenser. The energy recovery device has an inlet and an outlet. The inlet is fluidly connected to the valve to receive high-pressure refrigerant and the outlet is fluidly connected to the evaporator to deliver low-pressure refrigerant thereto. The energy recovery device is configured to extract work from flow of refrigerant therethrough. When the valve is closed and refrigerant flow cutoff, suction power loss is reduced by introduction of one or both of high-pressure refrigerant or low pressure refrigerant via one or more bypass passages.

20 Claims, 8 Drawing Sheets

AIR CONDITIONING SYSTEM

BACKGROUND OF THE INVENTION

1. Field of the Invention

The present invention relates to an air conditioning system. More specifically, the present invention relates to an air conditioning system with an energy recovery device that extracts work from expanding refrigerant moving from a high-pressure zone to a lower pressure zone of the air conditioning system.

2. Background Information

Air conditioning systems and heat pump systems are continuously being re-designed and modified in order to improve energy efficiency of such systems.

One such improvement is described in U.S. Pat. No. 6,272,871 wherein an air conditioning system is provided with an energy recovery device. The energy recovery device is basically a vane-type expander that is located downstream from a compressor (a high pressure zone) and downstream from an expansion valve. The energy recovery device is further located upstream from an evaporator (a low pressure zone) of the air conditioning system. High-pressure refrigerant from the compressor is released by the expansion valve and flows through the expander prior to reaching the evaporator. The expansion of the high-pressure refrigerant within the expander causes the expander to rotate, thereby producing rotary motion (work). The rotation of the expander can be used, for example, to provide supplemental rotary power to the compressor. Alternatively, the expander can be connected to a generator to produce electrical current.

The expander extracts work from the expanding refrigerant in a simple manner. The expander basically includes a housing having a chamber with an inner surface, a shaft mounted rotor within the chamber and a plurality of sliding vanes supported within slots in the rotor. The inner surface of the chamber is offset from the shaft that supports the rotor. The vanes can be biased by springs within the slot of the rotor to press against the inner surface of the housing chamber. As the rotor rotates, the vanes slide radially outward but are confined by the inner surface of the chamber. Since the shaft and rotor are axially offset from the center of the chamber, the volume of the space between any two adjacent vanes changes (increases or decreases) as the rotor rotates. The volume of the space between adjacent vanes proximate an inlet side of the chamber is smaller. The volume of the space between adjacent vanes proximate an outlet side of the chamber is larger. The expanding refrigerant migrates toward the outlet side rotating the rotor thus producing work.

In view of the above, it will be apparent to those skilled in the art from this disclosure that there exists a need for an improved air conditioning system that further improves the operation and efficiency of air conditioning systems. This invention addresses this need in the art as well as other needs, which will become apparent to those skilled in the art from this disclosure.

SUMMARY OF THE INVENTION

It has been discovered that in an air conditioning systems that employs an expander as an energy recovery device, the rotor of the expander slows down or stops rotating under certain conditions, thereby loosing momentum. Specifically, when the flow of high-pressure refrigerant the expander is stopped, vacuum or suction is produced between adjacent vanes moving from a lower volume area of the expander to a larger volume area of the expander. This suction effects the rotation of the expander and can act as a brake, slowing or stopping rotation of the expander, resulting in a phenomenon referred to as suction loss (energy loss resulting from suction). As a result, rotary momentum of the rotor of the expander is retarded causing a loss of energy and a loss of potential work produced from the energy recovery device.

One object of the invention is to reduce and/or eliminate the suction loss that occurs in energy recovery devices such as an expander in an air conditioning system.

In accordance with one aspect of the present invention, an air conditioning system is provided with an evaporator, a compressor, a condenser, a valve (expansion valve or throttling valve) an energy recovery device and a bypass passage. The compressor is fluidly connected to the evaporator to compress low-pressure refrigerant exiting the evaporator to high-pressure refrigerant. The condenser is fluidly connected to the compressor to receive the high-pressure refrigerant and dissipate heat therefrom. The valve is configured to control flow of high-pressure refrigerant exiting the condenser. The energy recovery device has an inlet fluidly connected to the valve to receive high-pressure refrigerant and an outlet fluidly connected to the evaporator to deliver low-pressure refrigerant thereto. The energy recovery device is also configured to extract work from flow of refrigerant therethrough. The bypass passage is located downstream from the inlet of the energy recovery device and upstream from the outlet of the energy recovery device. The bypass passage is also configured to deliver an auxiliary flow of refrigerant to the energy recovery device to reduce suction power loss.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
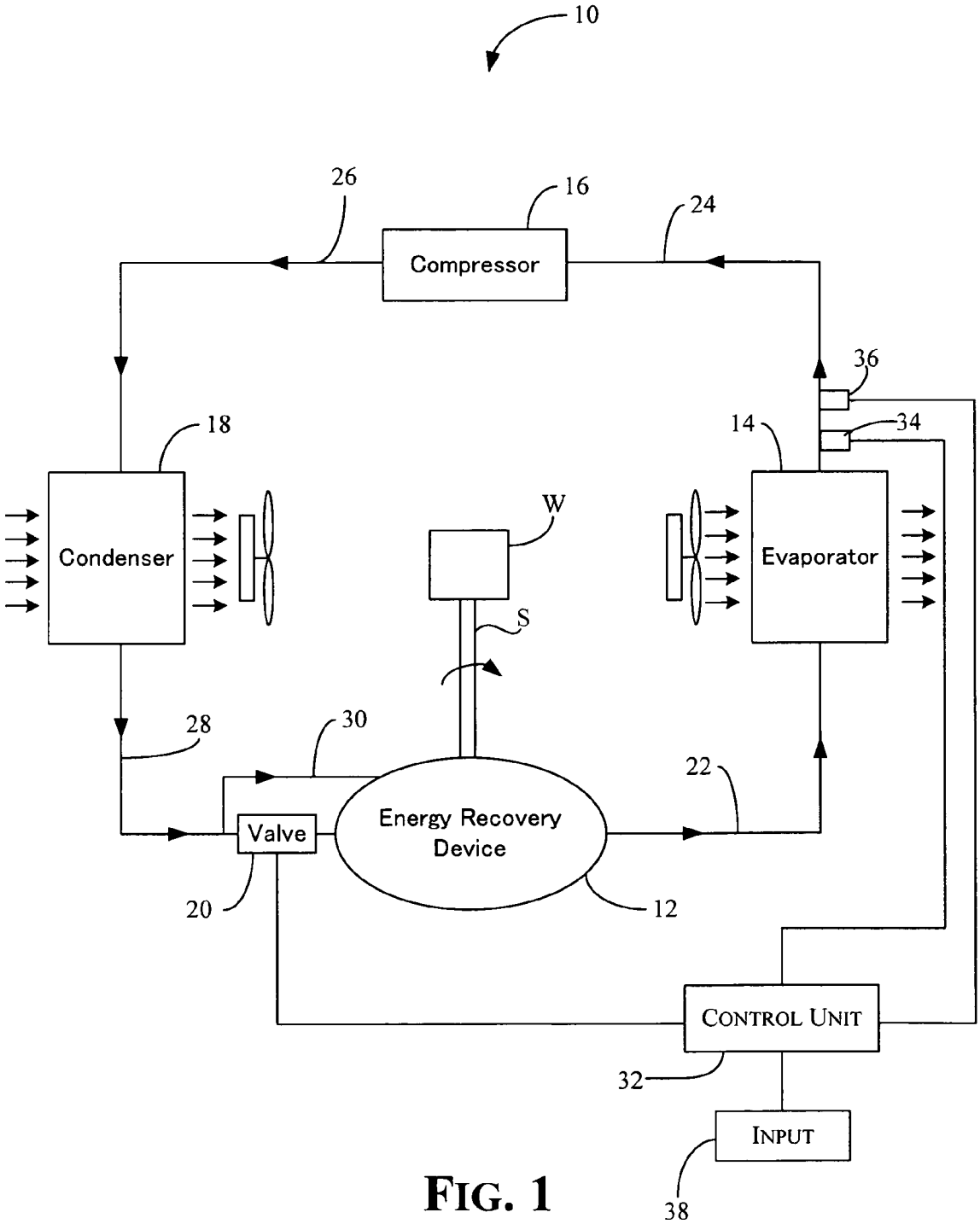
FIG. 1 is a schematic view of an air conditioning system showing an energy recovery device, an evaporator, a compressor, a condenser, a valve and a bypass passage in accordance with the present invention.

Referring initially to FIG. 1, an air conditioning system 10 is illustrated in accordance with a first embodiment of the present invention. The air conditioning system 10 is suitable for use in a motor powered vehicle or a stationary heat pump/air conditioning system. The air conditioning system 10 includes an energy recovery device 12 that extracts energy (work) from expansion of refrigerant as the refrigerant moves from a high-pressure zone of the air conditioning system 10 to a low-pressure zone of the air conditioning system 10. The energy recovery device 12 includes a lock-up prevention feature, described in greater detail below.

As shown schematically in FIG. 1, the air conditioning system 10 basically includes an evaporator 14, a compressor 16, a condenser 18, a valve 20, low-pressure lines 22 and 24, high-pressure lines 26 and 28, a bypass line 30, a control unit 32 and the energy recovery device 12. The compressor 16, the high-pressure line 26, the condenser 18 and the high-pressure line 28 generally define the high-pressure zone of the air conditioning system 10. The outlet side of the energy recovery device 12, the low pressure line 22, the evaporator 14 and the low-pressure line 24 generally define the low-pressure zone of the air conditioning system 10.

The evaporator 14 is a conventional element of the air conditioning system 10 and serves to absorb heat outside the evaporator 14. The evaporator 14 can include a blower or fan which forces air past the evaporator 14 for improved heat transfer. Heat in the moving air is in turn absorbed by low-pressure refrigerant within the evaporator 14. Optimally, the refrigerant within the evaporator 14 is a vapor state, or a liquid-vapor state. The low-pressure line 24 fluidly connects the evaporator 14 to the compressor 16.

Refrigerant exiting the evaporator 14 is directed to the compressor 16 via the low-pressure line 24. The compressor 16 preferably compresses the refrigerant in a conventional manner into high-pressure refrigerant in the vapor state. The high-pressure refrigerant compressed by the compressor 16 exits the compressor 16 via the high-pressure line 26. The high-pressure line 26 is further fluidly connected to the condenser 18 in a conventional manner.

Figure 2:
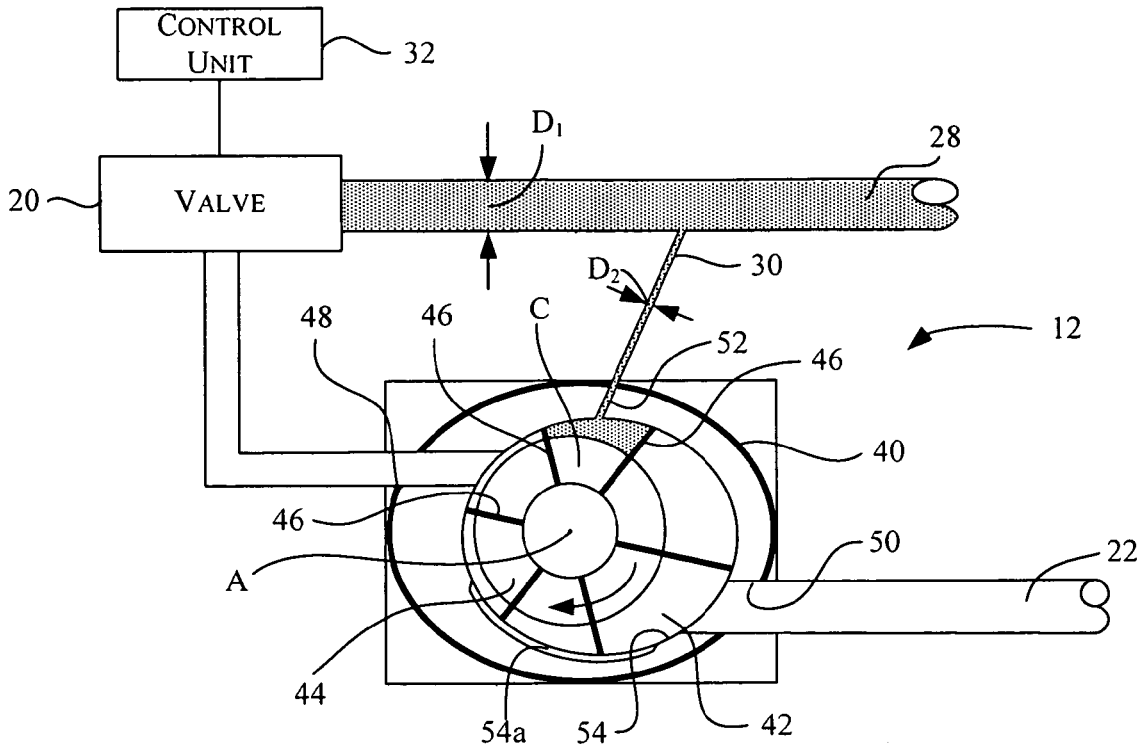
FIG. 2 is a schematic view of a portion of the air conditioning system depicted in FIG. 1, showing a high pressure line, the valve, the energy recovery device and the bypass passage, the energy recovery device having a expansion chamber, a rotor and a plurality of vanes within the expansion chamber, further showing the valve in a closed position with a small amount of high pressure refrigerant flowing to a small volume space within the expansion chamber to reduce suction loss, the small volume space being defined between two adjacent vanes of the energy recovery device in accordance with a first embodiment of the present invention.

The condenser 18 can include a blower or fan that forces air past the condenser 18 for improved heat transfer. Hence, the high-pressure refrigerant within the condenser 18 is cooled by airflow in a conventional manner. The cooled high-pressure refrigerant is then directed to the valve 20 via the high-pressure line 28, in a conventional manner. As indicated in FIG. 2, the high-pressure line 28 has an internal diameter $D_1$.

Returning again to FIG. 1, the valve 20 is operable to selectively release the high-pressure refrigerant into the energy recovery device 12. The valve 20 acts as a throttling device to promote cavitation of the high-pressure refrigerant as it enters a low volume space within the energy recovery device 12. The valve 20 is preferably configured to operate with little pressure drop. In other words, when open, the valve 20 allows for a significant flow of high pressure refrigerant into the energy recovery device 12 in order to maximize the amount of work extracted from the expanding refrigerant moving from the high pressure line 28 toward the low pressure line 22. However, it should be understood from the drawings and the description herein that the actual operation of the valve 20 and the level of flow of refrigerant therethrough are design considerations that depend upon such factors as the configuration of the air conditioning system 10, the cooling/heating loads placed upon the air conditioning system 10 and the work desired or required from the energy recovery device 12. It should also be understood that the expansion of refrigerant within the energy recovery device 12 causes a corresponding drop in refrigerant pressure as the refrigerant moves to the low pressure zone of the air conditioning system 10.

The valve 20 is preferably connected to the control unit 32. The control unit 32 preferably includes a microprocessor that is connected to a pressure sensor 34, a temperature sensor 36 and a user input panel 38. The pressure sensor 34 is preferably mounted to the low-pressure line 24 and detects refrigerant pressure within the low-pressure line 24. The temperature sensor 36 is preferably located proximate the evaporator 14 in or on the low-pressure line 24. Signals from the pressure sensor 34 and the temperature sensor 36 are processed by the control unit 32. In response to measured pressure and/or temperature conditions, the control unit 32 opens and closes the valve 20 to maintain a desired pressure condition within the low-pressure line 24 and/or desired temperature proximate the evaporator 14.

It should be understood that the temperature sensor 36 can be omitted and the control unit 32 can be connected to only the pressure sensor 34 in order to control the opening and closing of the valve 20. In such a case, a conventional accumulator (not shown) can be added to low-pressure line 24.

A primary purpose of the control unit 32 is to provide a cold evaporator temperature that is above the freezing point of water, while ensuring that the refrigerant entering the compressor is in the vapor phase. This facilitates good compression behavior at the compressor 16 and A/C cooling performance.

Hence, the valve 20 is connected to the control unit 32 (a microcomputer) that is further connected to at least one of the pressure sensor 34 and the temperature sensor 36 of the air conditioning system 10 and is configured to control the flow of high pressure refrigerant exiting the condenser 18 and entering the energy recovery device 12.

The valve 20 selectively releases the high pressure refrigerant into the energy recovery device 12 allowing cavitation and expansion of the high pressure refrigerant as the refrigerant moves from the high pressure zone into the low pressure zone. Specifically, the refrigerant changes phase from a generally liquid phase to a part vapor/part liquid phase. The expansion of the refrigerant to a gaseous phase releases energy that is at least partially captured by the energy recovery device 12 to produce work, as described in greater detail below.

The bypass line 30 extends from the high-pressure line 28 to the energy recovery device 12, thereby bypassing the valve 20 as described in greater detail below. The bypass line 30 preferably has an internal diameter $D_2$, as shown in FIG. 2. The ratio of the internal diameter $D_1$ of the high-pressure line 28 to the internal diameter $D_2$ of the bypass line 30 is preferably approximately 100:1. Put another way, the ratio of the internal diameter $D_2$ of the bypass line 30 to the internal diameter $D_1$ of the high-pressure line 28 is preferably approximately 1:100.

It should be understood from the drawings and description herein that the actual ratio of the internal diameter $D_1$ to the internal diameter $D_2$ is a variable dimension dependent upon a variety of engineering factors, such as the cooling or heat transference capacity of the air conditioning system 10, the amount of work anticipated or required from the energy recovery device 12 and/or the application of the air conditioning system 10. For example, the air conditioning system 10 can be used in a vehicle (not shown), a heat pump system or air conditioning system in commercial building or household applications. In a vehicle, the energy recovery considerations and uses of work extracted by the energy recovery device 12 can be significantly different than those of an energy recovery device in an air conditioning system installed in a commercial building.

With specific reference to FIG. 2, a description of the energy recovery device 12 is now provided. The energy recovery device 12 is preferably a vane-type expander that uses the movement of high-pressure gas from the high-pressure zone of the air conditioning system 10 to the low-pressure zone and extracts energy in order to produce work. The energy recovery device 12 can be any of a variety of conventional expander devices, a specially made expander or conventional air motor that have been modified to accommodate the features of the present invention as described in greater detail below. Specifically, the energy recovery device 12 is configured to produce rotational movement from the flow of refrigerant therethrough.

As shown in FIG. 1, the energy recovery device 12 can be connected via a shaft S to a work utilizing device W which is an electricity generator in the depicted embodiment. However, it should be understood that the work-utilizing device W could be a fan (not shown) or a one-way clutch and gear assembly connected to the compressor 16 in order to take advantage of the rotational energy produced by the energy recovery device 12.

As shown in FIG. 2, the energy recovery device 12 basically includes a housing 40, an expansion chamber 42, a rotor 44, vanes 46, an inlet 48, an outlet 50 and a bypass port 52. The expansion chamber 42 is formed within the housing 40. The rotor 44 is rotatably supported within the expansion chamber 42. The expansion chamber 42 includes an inner surface 54. The expansion chamber 42 also includes a notch **54*a* that extends along a portion of the inner surface 54**.

Typically, the rotor 44 rotates about an axis A that is off-center with respect to the expansion chamber 42, as indicated in FIG. 2. The vanes 46 are slidably supported by the rotor 44 such that the vanes 46 can extend and retract relative to the inner surface 54 of the rotor 44. For example, the rotor 44 can include recesses, one recess for each of the vanes 46. Biasing springs (not shown) are disposed within each recess urging the vanes 46 radially outward such that the vanes 46 contact and press against the inner surface 54 of the expansion chamber 42. The vanes 46 are spaced apart from one another by a prescribed or predetermined angular distance. In the energy recovery device 12 depicted in FIG. 2, there are six vanes angularly spaced apart by an angle of 60 degrees. It should be understood from the drawings and description herein that the number of vanes 46 is variable depending a variety of design considerations, such as air conditioning capacity, work to be extracted by the energy recovery device 12 and/or application of the air conditioning system 10. For example, the energy recovery device 12 can have as few as four vanes or a larger number, if design requirements dictate an increased number. For instance, the energy recovery device 12 can include 30 or more vanes, if appropriate for the air conditioning system application.

The inlet 48 is open to the expansion chamber 42 and is further fluidly connected to the valve 20 such that when the valve 20 is open, high-pressure refrigerant passes from the valve 20 to the expansion chamber 42 of the energy recovery device 12. The outlet 50 also is open to the expansion chamber 42 and is further fluidly connected to the low-pressure line 22 such that refrigerant expanding within the expansion chamber 42 exhausts to the low-pressure line 22. Since the low-pressure line 22 is fluidly connected to the evaporator 14, expanding refrigerant in the expansion chamber 42 passes through the outlet 50, through the low-pressure line 22 and to the evaporator 14.

Adjacent to the inlet 48, the configuration and shape of the expansion chamber 42 is such that the volume of the space between adjacent pairs of vanes 46 is small. However, as the rotor 44 rotates, the volume between those same adjacent pairs of vanes 46 increases as the vanes 46 approach the outlet 50. The volume of refrigerant between the moving vanes 46 similarly increases and pressure of the refrigerant decreases. The moving refrigerant pushes the vanes 46 from the portion of the expansion chamber 42 adjacent to the inlet 48 toward the outlet 50. The movement of the refrigerant causes the rotor 44 to rotate and work is produced. When the valve 20 is shut, the flow of refrigerant is stopped and the rotor 44 stops in the absence of an auxiliary flow of refrigerant, due to suction generated between adjacent vanes 46 rotating toward the outlet 50 (where volume between adjacent vanes 46 is increasing). However, with an auxiliary flow of refrigerant entering the expansion chamber 42 via the bypass port 52, rotation of the rotor 44 can continue, as explained in greater detail below.

The bypass port 52 (a bypass passage) extends through the housing 40 to the expansion chamber 42. The bypass line 30 is fluidly connected to the bypass port 52. The bypass port 52 and the bypass line 30 define a passage that extends from the high-pressure line 28 to the expansion chamber 42. The dimensions of the bypass line 30 and the bypass port 52 are preferably the same, but depending upon design criteria, can have different internal dimensions. However, in the depicted embodiment, the bypass line 30 and bypass port 52 have internal diameters $D_2$.

The bypass port 52 (the bypass passage) is located downstream from the inlet 48 and upstream from the outlet 50 of the energy recovery device 12, as indicated in FIG. 2. The bypass port 52 and bypass line 30 are configured to deliver a continuous auxiliary flow of refrigerant to the energy recovery device 12 to reduce suction related power loss when the valve 20 is closed. Specifically, when the valve 20 shuts and the normal flow of refrigerant to the energy recovery device 12 stops, the rotor 44 does not come to a complete stop because of the auxiliary flow refrigerant from the bypass port 52.

The auxiliary flow of refrigerant through the bypass port 52 and the bypass line 30 allows the rotor 44 to continue rotating. Specifically, the bypass line 30 and the bypass port 52 (the bypass passage) are configured to receive a restricted flow of high-pressure refrigerant from the high-pressure line 28 at a location downstream from the compressor 16 and upstream from the valve 20. The bypass passage basically serves a rotor lock-up prevention feature.

Figure 3:
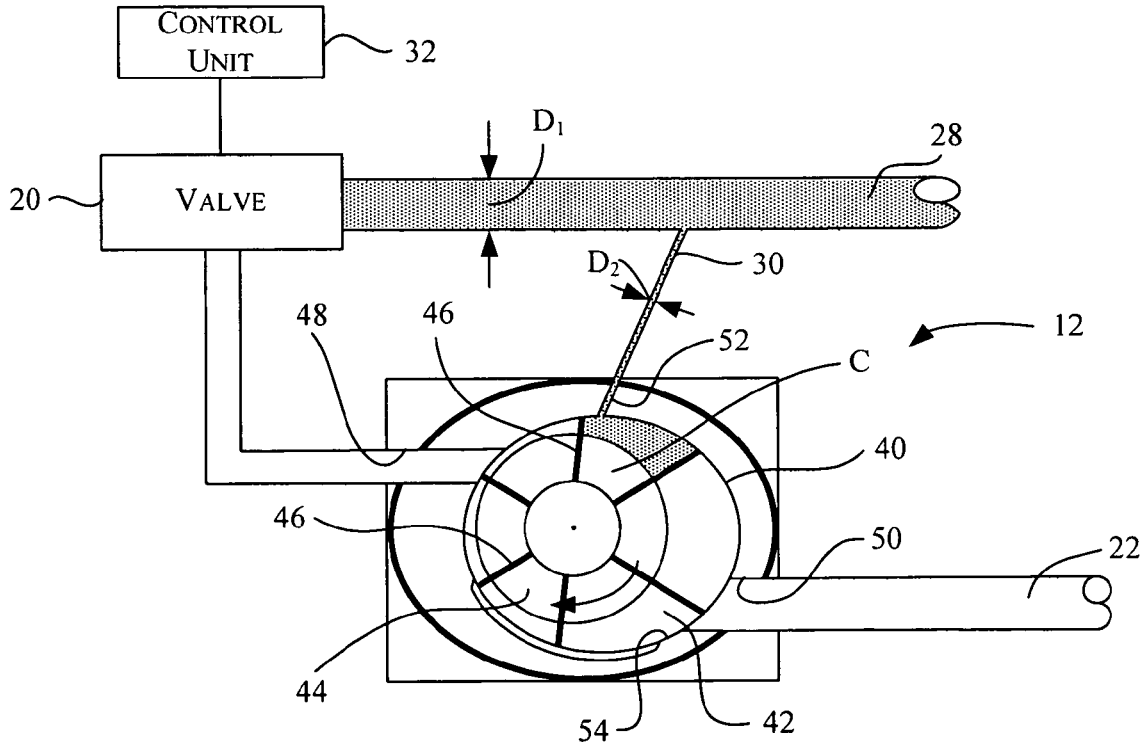
FIG. 3 is another schematic view of the portion of the air conditioning system similar to FIG. 2, showing the valve in the closed position with the high pressure refrigerant in the small volume space expanding thereby allowing rotation of the rotor in accordance with the first embodiment of the present invention.
Figure 4:
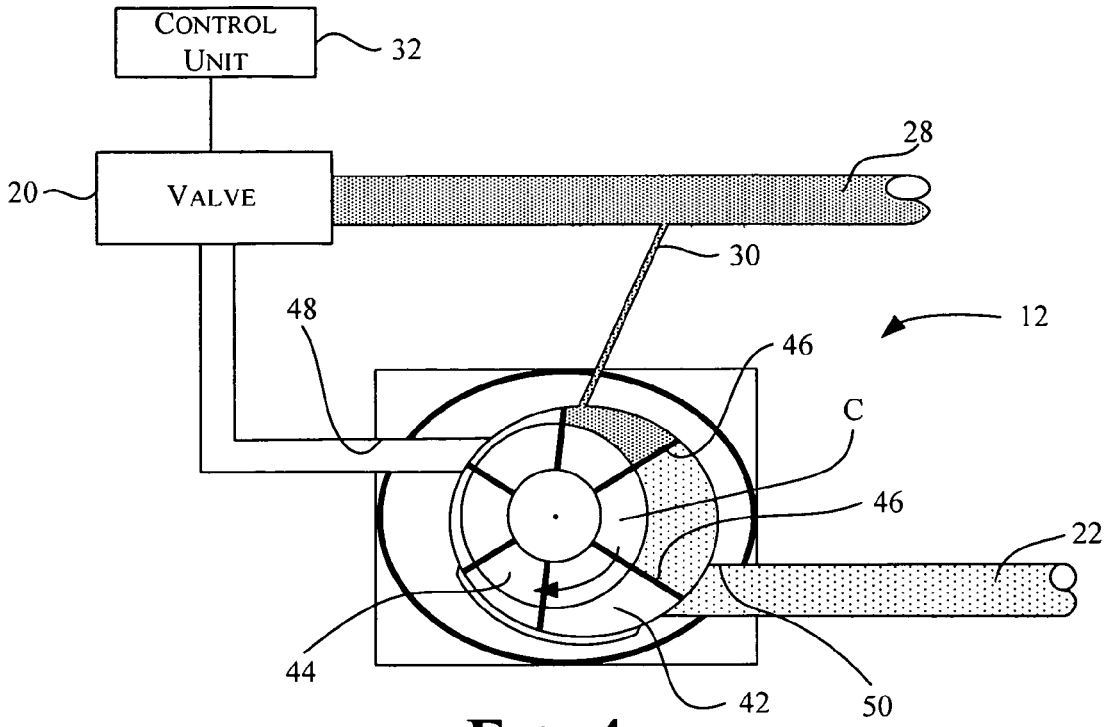
FIG. 4 is another schematic view of the portion of the air conditioning system similar to FIGS. 2 and 3, showing the valve in the closed position with the refrigerant between the two adjacent vanes further expanding and moving to a larger volume area of the chamber allowing the rotor to continue rotating, and allowing the refrigerant to exhaust to a low pressure zone of the air conditioning system in accordance with the first embodiment of the present invention.

An explanation of operation of the energy recovery device 12 when the valve 20 is shut is now provided with specific reference to FIGS. 2, 3 and 4. As shown schematically in FIG. 2, a restricted flow of high-pressure refrigerant is provided to the space between an adjacent pair of the vanes 46 adjacent to a reference mark C on the rotor 44. The high-pressure refrigerant expands causing (or allowing) the rotor 44 to continue rotating. With the rotor 44 in the position shown in FIG. 3, the volume of the space between the adjacent pair of the vanes 46 at the reference mark C has increased. As shown in FIG. 4, continued expansion of the refrigerant between the vanes 46 at the reference mark C exhaust to the outlet 50 and the low-pressure line 22. With the auxiliary flow of refrigerant to the expansion chamber 42, no suction is generated as the pair of vanes 46 at the reference mark C as the rotor 44 rotates. Hence, rotational momentum in the rotor 44 present at the time the valve 20 shuts is not lost and the rotor 44 can continue to rotate. Further, since the bypass port 52 is continuously supplied with a limited flow of high pressure refrigerant, the rotor 44 can continue to rotate as each adjacent pair of vanes 46 passes from a low volume side of the expansion chamber 42 adjacent to the inlet 48 to a high volume side of the expansion chamber 42 adjacent to the outlet 50 even though the valve 20 is shut.

It should be understood that the flow of high-pressure refrigerant through the bypass line 30 and the bypass port 52 into the expansion chamber 42 is generally small. As mentioned above, the internal diameter $D_2$ of the bypass line 30 and the bypass port 52 is preferably approximately one hundredth ($1/100^{th}$) of the internal diameter $D_1$ the high pressure line 28. Therefore, the flow of high-pressure refrigerant through the bypass port 52 is preferably limited.

Preferably, the flow through the bypass port 52 is sufficient to allow the rotor 44 to continue rotating, but insufficient to extract an appreciable amount of work. The primary purpose of the flow of high pressure refrigerant through the bypass port 52 into the expansion chamber 42 is to prevent significant braking forces due to suction from eliminating the rotational momentum present in the rotor 44 when the valve 20 is closed. In other words, the present invention is directed to a configuration, which allows for maintaining rotation of the rotor 44 when the valve 20 is closed.

The notch 54*a* that extends along a portion of the inner-surface 54 is located on the volume decreasing side of the expansion chamber 42. The notch 54*a* provides a gap between the vanes 46 and the inner surface 54 during volume reduction between adjacent vanes 46 thereby reducing or eliminating energy losses due to compression of gas or vapor located between adjacent vanes 46 as the volume therein decreases.

Second Embodiment

Figure 5:
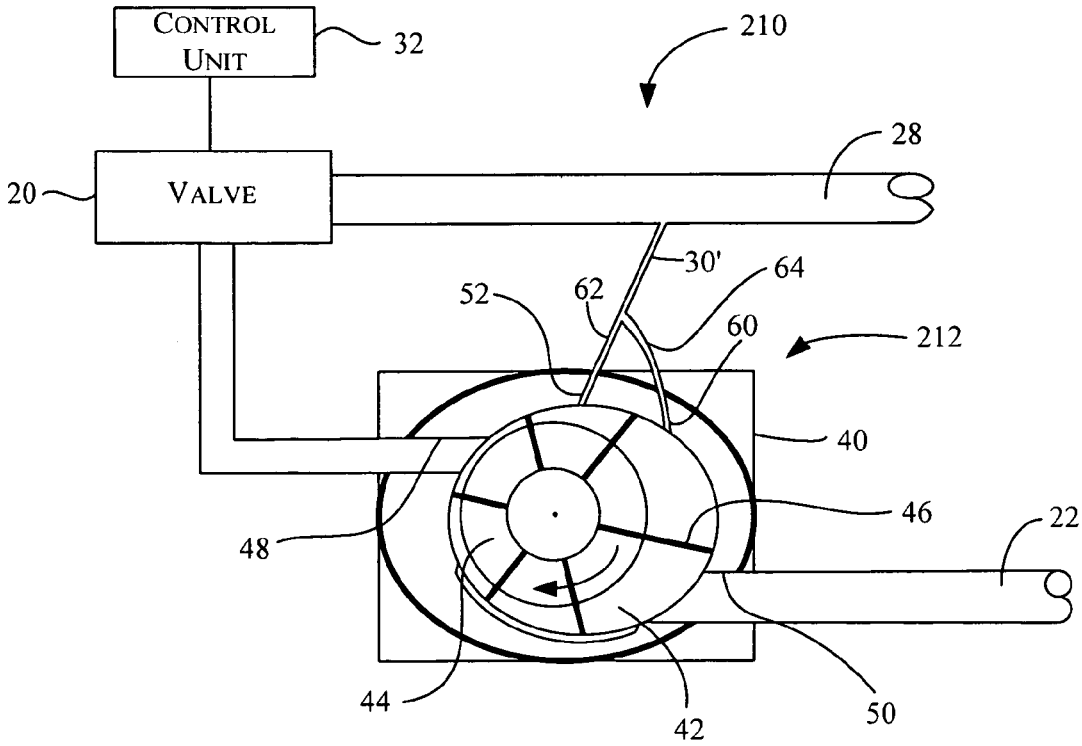
FIG. 5 is another schematic view of the portion of the air conditioning system showing an energy recovery device with two bypass passages allowing dual flows of small amounts of high pressure refrigerant to spaces within the chamber between adjacent vanes of the energy recovery device in accordance with a second embodiment of the present invention.

Referring now to FIG. 5, an energy recovery device 212 of an air conditioning system 210 shown in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (') or be given a new reference numeral.

In the second embodiment, the energy recovery device 212 includes many of the same features as in the first embodiment, such as the housing 40, the expansion chamber 42, the rotor 44, the vanes 46, the inlet 48, the outlet 50 and the bypass port 52. The energy recovery device 212 differs from the first embodiment in that a second bypass port 60 is added. The second bypass port 60 defines a second bypass passage. Further, a bypass line 30' replaces the bypass line 30 of the first embodiment. The bypass line 30' extends from the high-pressure line 28 and includes first and second tube branches 62 and 64. The first tube branch 62 is fluidly connected to the bypass port 52 and the second tube branch 64 is fluidly connected to the second bypass port 60.

The second bypass port 60 (second bypass passage) is located between the bypass port 52 (the first bypass passage) and the outlet 50. The second bypass port 60 is configured to receive an auxiliary flow of high-pressure refrigerant to reduce suction power loss within the energy recovery device 212. The second bypass port 60 and the bypass port 52 are angularly offset from one another by an angle that approximately corresponds to the angular offset between adjacent pairs of the vanes 46, as indicated in FIG. 5. However, it should be understood from the description and the drawings herein that the separation or distance between the second bypass port 60 and the bypass port 52 is an engineering consideration that can depend upon a variety of factors, such as the number of vanes 46 provided in the energy recovery device 212, the relative speeds of rotation of the rotor 44 with the valve 20 on and off and the optimal pressures at the inlet 48 and the outlet 50, among other considerations.

Third Embodiment

Figure 6:
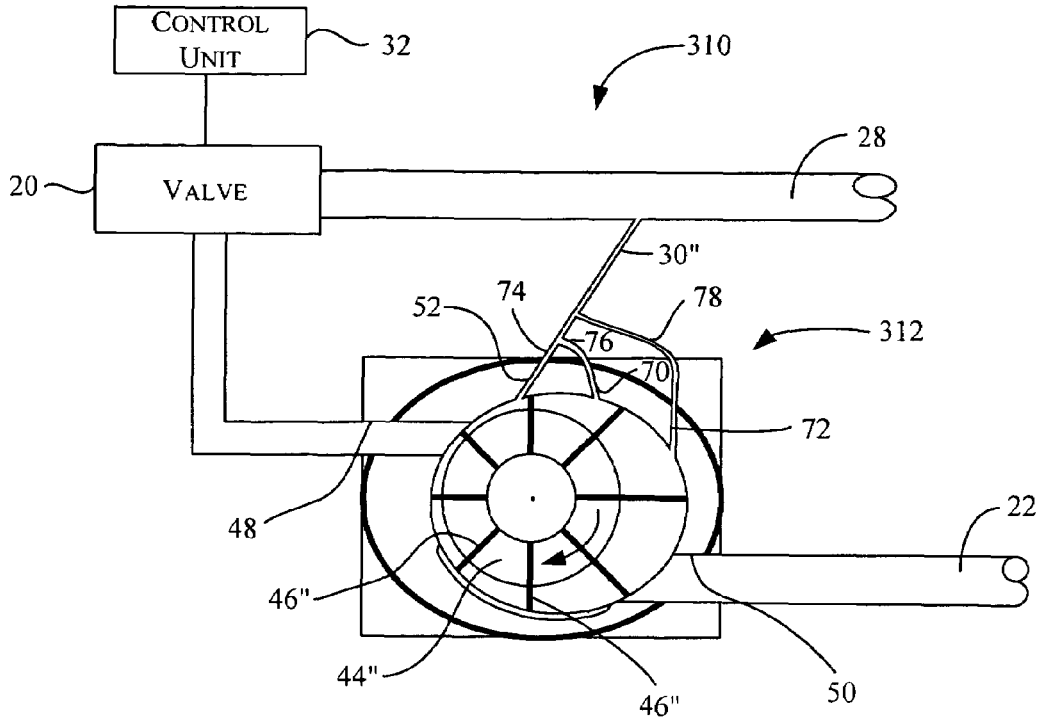
FIG. 6 is another schematic view of the portion of the air conditioning system showing an energy recovery device with three bypass passages allowing multiple flows of small amounts of high pressure refrigerant to spaces within the chamber between adjacent vanes of the energy recovery device in accordance with a third embodiment of the present invention.

Referring now to FIG. 6, an energy recovery device 312 of an air conditioning system 310 shown in accordance with a third embodiment will now be explained. In view of the similarity between the first, second and third embodiments, the parts of the third embodiment that are identical to the parts of the first and/or second embodiments will be given the same reference numerals as the parts of the first and/or second embodiments. Moreover, the descriptions of the parts of the third embodiment that are identical to the parts of the first and/or second embodiment may be omitted for the sake of brevity. The parts of the third embodiment that differ from the parts of the first embodiment will be indicated with a double prime (") or be given a new reference numeral.

In the third embodiment, the energy recovery device 312 includes many of the same features as in the first and second embodiments, such as the housing 40, the expansion chamber 42, the inlet 48, the outlet 50 and the bypass port 52. The energy recovery device 312 differs from the first and second embodiments in that the energy recovery device 312 includes a plurality of bypass passages between the inlet 48 and the outlet 50 that are configured to receive corresponding auxiliary flows of refrigerant to reduce suction power loss within the energy recovery device 312. The energy recovery device 312 also includes eight vanes 46" supported by a rotor 44", whereas in the first and second embodiments only six of the vanes 46 are depicted (see FIGS. 2-4). An increase in the number of vanes requires a corresponding increase in the number of bypass passages.

Specifically, the energy recovery device 312 includes the bypass port 52, a second bypass port 70 and a third bypass port 72, defining three bypass passages. Further, a bypass line 30" replaces the bypass line 30 of the first embodiment. The bypass line 30" extends from the high-pressure line 28 and includes first, second and third tube branches 74, 76 and 78. The first tube branch 74 is fluidly connected to the bypass port 52, the second tube branch 76 is fluidly connected to the second bypass port 70 and the third tube branch 78 is fluidly connected to the third bypass port 72.

The bypass passages are offset from one another within the energy recovery device 312 by distances approximately corresponding to the angular offset between the adjacent ones of the vanes 46" of the energy recovery device 312.

Fourth Embodiment

Figure 7:
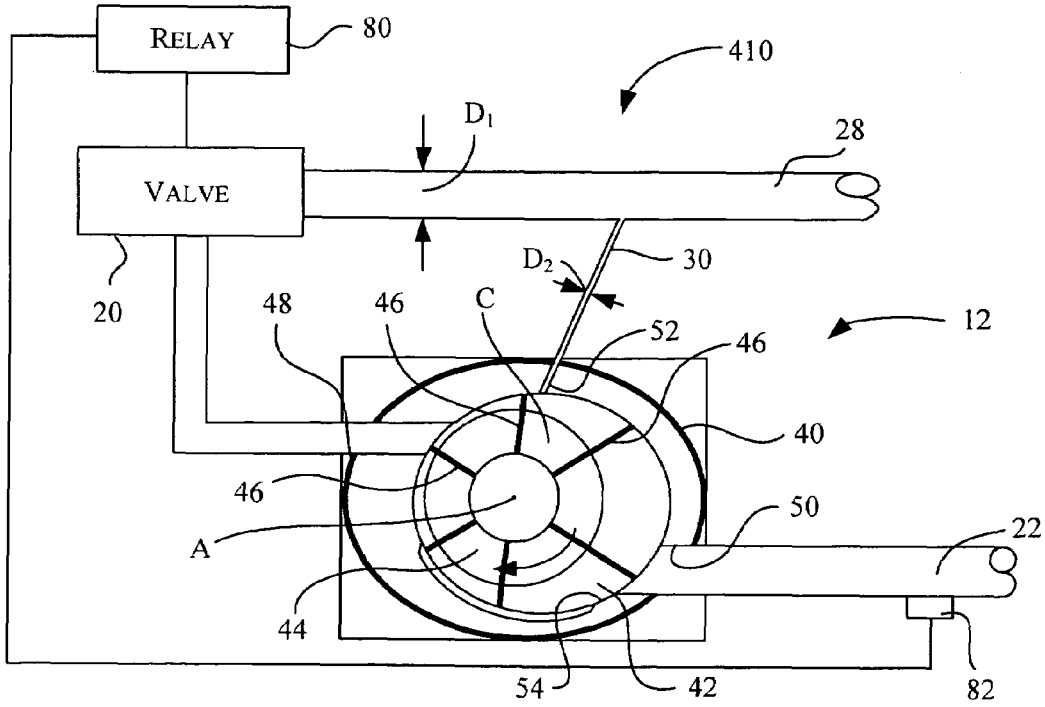
FIG. 7 is another schematic view of the portion of the air conditioning system showing an energy recovery device of an air conditioning system that includes a simplified control system for regulating flow of high pressure refrigerant to the energy recovery device, in accordance with a fourth embodiment of the present invention.

Referring now to FIG. 7, a portion of an air conditioning system 410 shown in accordance with a fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity. The parts of the fourth embodiment that differ from the parts of the first embodiment will be indicated a new reference numeral.

In the fourth embodiment, the control unit 32 of the first embodiment has been replaced with a simple relay 80 for controlling opening and closing of the valve 20. The relay 80 is connected to a pressure sensor 82 that is installed in either the low-pressure line 22 or the low-pressure line 24 (not shown in FIG. 7). When the pressure in the low-pressure line 22 falls below a prescribed level, the pressure sensor 82 provides a current or a voltage to the relay 80 allowing it to open the valve 20. Once the pressure within the low-pressure line 22 has reached another prescribed level, the relay 80 shuts the valve 20. Hence, the valve 20 is connected to the relay 80 that is configured to open the valve 20 in response to prescribed pressure conditions sensed by the pressure sensor 82.

In accordance with the fourth embodiment, the energy recovery device 12 having the bypass passage defined by the bypass line 30 and the bypass port 52 is utilized in a simplified air conditioning system such as the air conditioning system 410.

Fifth Embodiment

Figure 8:
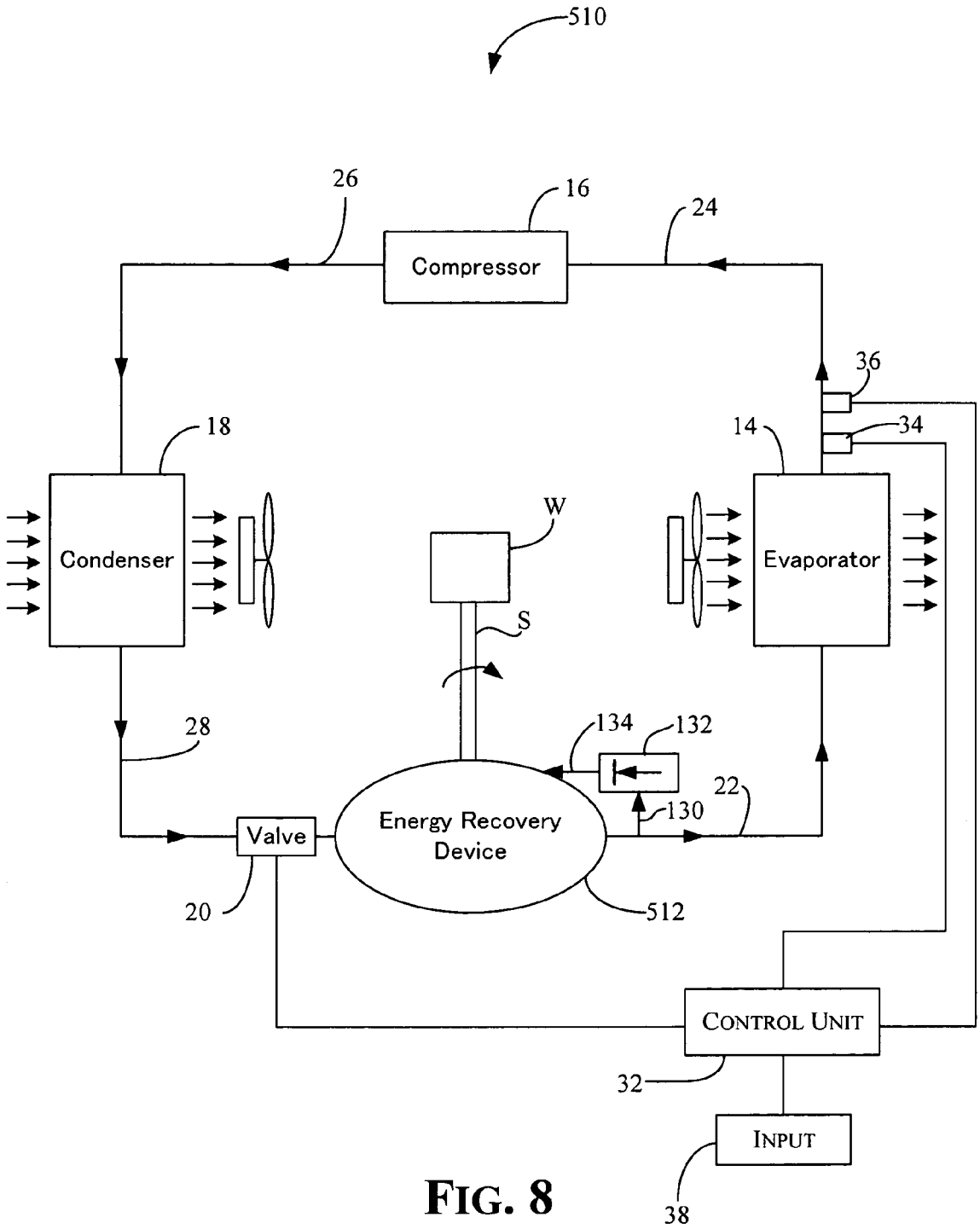
FIG. 8 is a schematic view of an air conditioning system similar to FIG. 1, showing an energy recovery device that includes a bypass passage and check valve provided with low pressure refrigerant flow to reduce suction losses in accordance with a fifth embodiment of the present invention.
Figure 9:
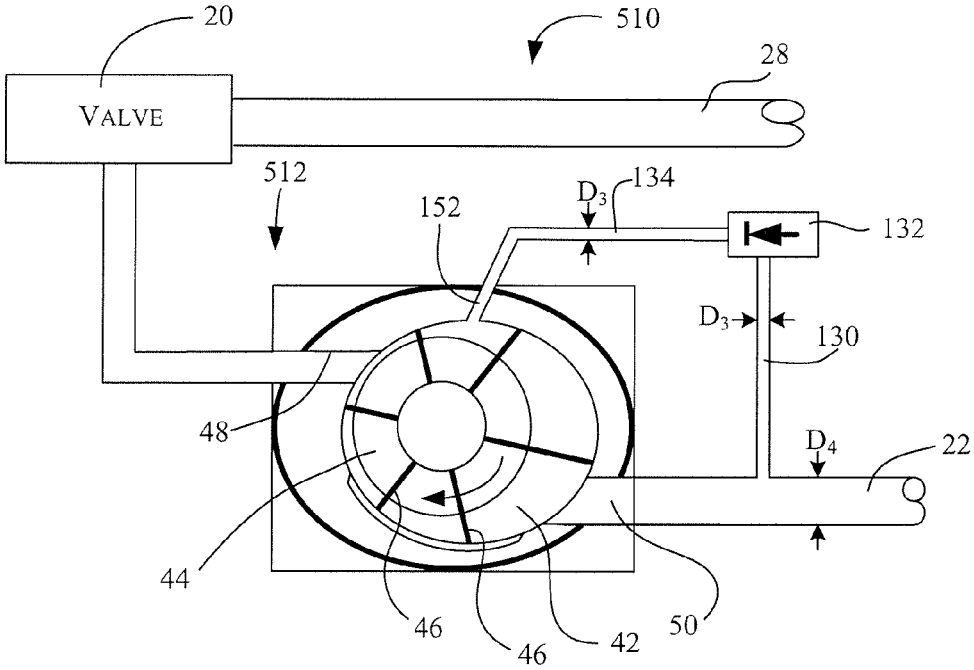
FIG. 9 is another schematic view of a portion of the air conditioning system depicted in FIG. 8 showing an energy recovery device where low pressure refrigerant is provided to a small volume space between adjacent vanes the energy recovery device via a single bypass passage to reduce suction losses when the valve is closed in accordance with the fifth embodiment of the present invention.

Referring now to FIGS. 8 and 9, a portion of an air conditioning system 510 shown in accordance with a fifth embodiment will now be explained. In view of the similarity between the first and fifth embodiments, the parts of the fifth embodiment that are identical to the parts of the first embodiment will be given the same reference numerals as the parts of the first embodiment. Moreover, the descriptions of the parts of the fifth embodiment that are identical to the parts of the first embodiment may be omitted for the sake of brevity. The parts of the fifth embodiment that differ from the parts of the first embodiment will be indicated a new reference numeral.

In the fifth embodiment, the energy recovery device 512 is the same as the energy recovery device 12 in the first embodiment except a bypass port 152 replaces the bypass port 52 of the first embodiment. The bypass port 152 of the fifth embodiment is significantly larger than the bypass port 52 of the first embodiment. Further, the bypass line 30 of the first embodiment has been eliminated in the air conditioning system 510.

Instead, the air conditioning system 510 is provided with a bypass pipe 130, a check valve 132 and a bypass line 134. The bypass port 152, the bypass pipe 130, the check valve 132 and the bypass line 134 are configured to receive low pressure refrigerant from a section of the air conditioning system 510 downstream from the energy recovery device 512. Specifically, in the air conditioning system 510, the bypass pipe 130 is fluidly connected to the low-pressure line 22. The bypass pipe 130 is further fluidly connected to the check valve 132. The check valve 132 is fluidly connected to the bypass line 134, which is fluidly connected to the bypass port 152.

The bypass port 152, the bypass pipe 130, the check valve 132 and the bypass line 134 serve as a bypass passage that delivers low pressure refrigerant from the low pressure line 22 downstream from the energy recovery device 512 to the bypass port 152.

The bypass port 152, the bypass pipe 130 and the bypass line 134 preferably have an internal diameter $D_3$ and the low-pressure line 22 has an internal diameter $D_4$. Preferably, the internal diameter $D_3$ is approximately half the size or less than that of the internal diameter $D_4$. In other words, the ratio of the internal diameter $D_4$ to the internal diameter $D_3$ is approximately two to one (2:1).

In the air conditioning system 510, suction power loss is eliminated or reduced by providing low-pressure refrigerant into the expansion chamber 42. The check valve 132 is preferably a spring-biased valve that is biased to open when the vapor pressure within the bypass line 134 (and the bypass port 152) is less than the vapor pressure within the bypass pipe 130. Therefore, when suction develops within the space between adjacent vanes 46 that are exposed to the bypass port 152, the check valve 132 opens and allows entry of low-pressure refrigerant. Hence, suction power loss is reduced or eliminated and the rotor 44 can continue to rotate when the valve 20 is closed.

Sixth Embodiment

Figure 10:
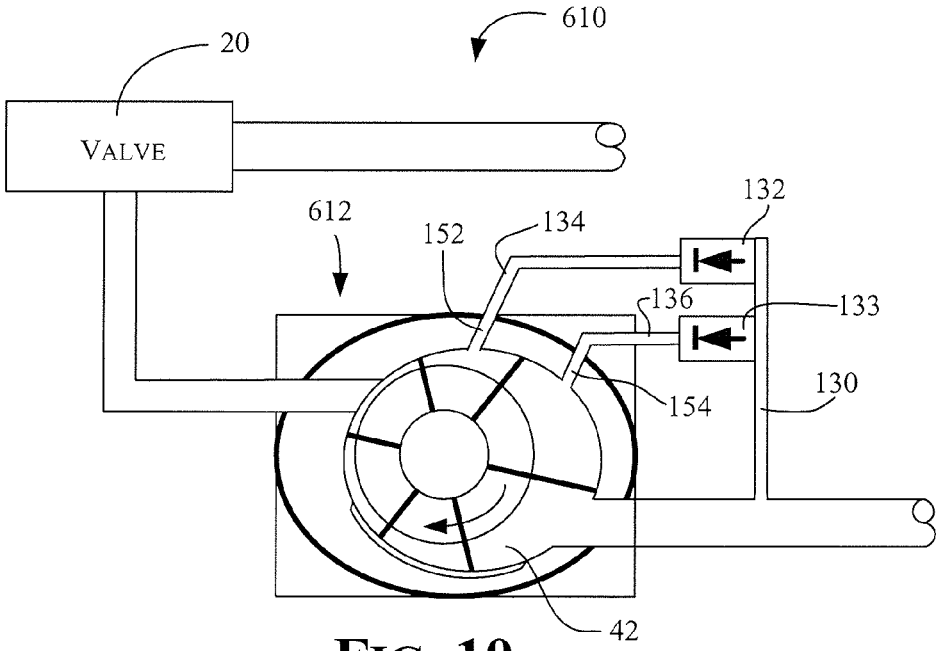
FIG. 10 is another schematic view of the portion of the air conditioning system showing an energy recovery device of an air conditioning system where low pressure refrigerant is provided to a plurality of spaces between adjacent pairs of the vanes the energy recovery device via at least two bypass passages to reduce suction losses when the valve is closed in accordance with a sixth embodiment of the present invention.

Referring now to FIG. 10, a portion of an air conditioning system 610 shown in accordance with a sixth embodiment will now be explained. In view of the similarity between the fifth and sixth embodiments, the parts of the sixth embodiment that are identical to the parts of the fifth embodiment will be given the same reference numerals as the parts of the fifth embodiment. Moreover, the descriptions of the parts of the sixth embodiment that are identical to the parts of the fifth embodiment may be omitted for the sake of brevity. The parts of the sixth embodiment that differ from the parts of the fifth embodiment will be indicated a new reference numeral.

In the sixth embodiment, an energy recovery device 612 replaces the energy recovery device 512 of the fifth embodiment. The energy recovery device 612 of the air conditioning system 610 is identical to the energy recovery device 512 of the fifth embodiment except that a second bypass port 154 has been introduced that extends to the expansion chamber 42. Further, a second check valve 133 is provided. The second check valve 133 is fluidly connected to a second bypass line 136 that extends from the second check valve 133 to the second bypass port 154. The check valve 132 and the second check valve 133 operate in the same manner as described above with respect to the fifth embodiment, except that the second check valve 133 provides low pressure refrigerant to the second bypass port 154.

Seventh Embodiment

Figure 11:
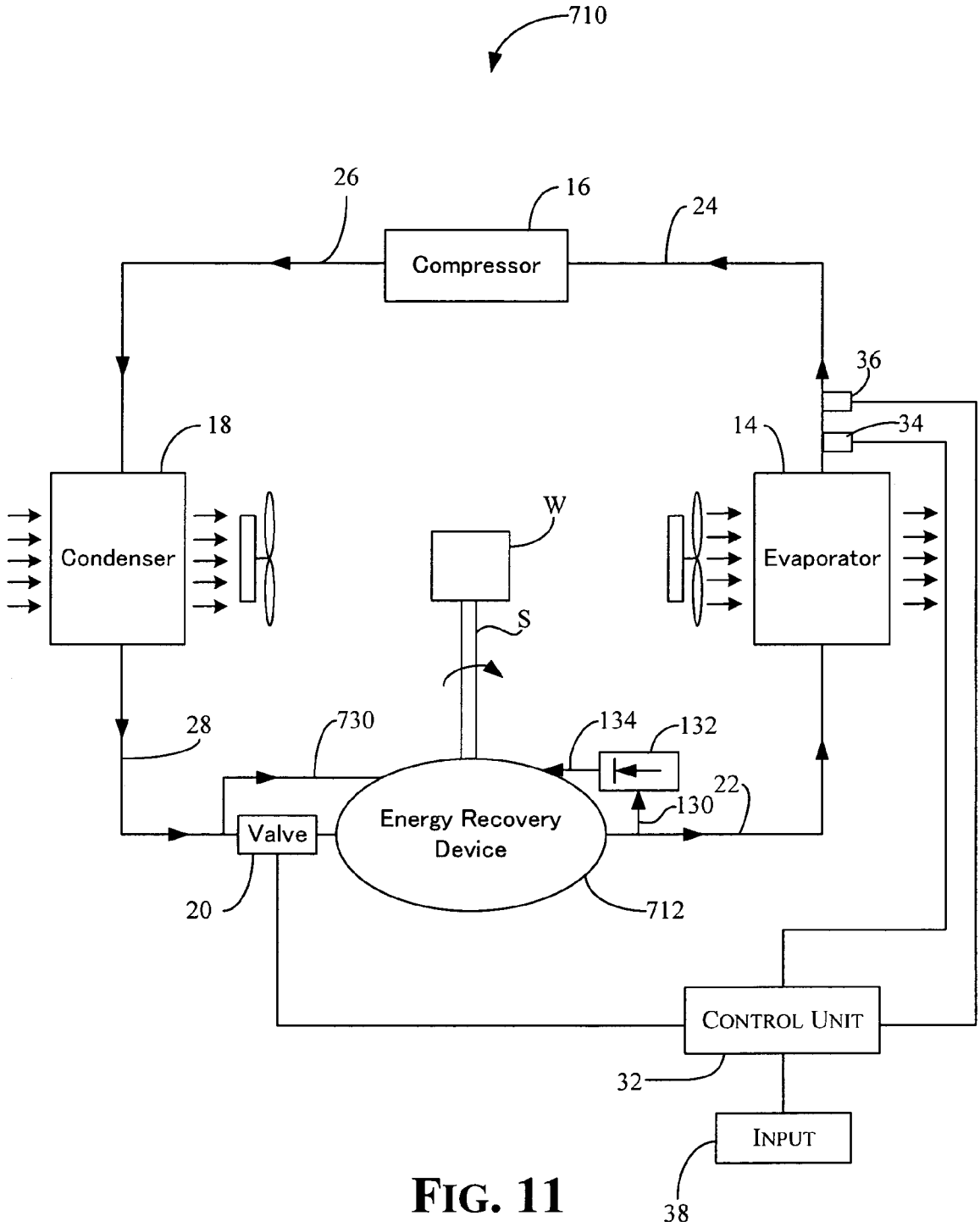
FIG. 11 is a schematic view of an air conditioning system similar to FIG. 1, showing an energy recovery device that includes two separate bypass passages, one bypass passage provided with high pressure refrigerant flow and the other bypass passage provided with low pressure refrigerant flow to reduce suction losses in accordance with a seventh embodiment of the present invention.
Figure 12:
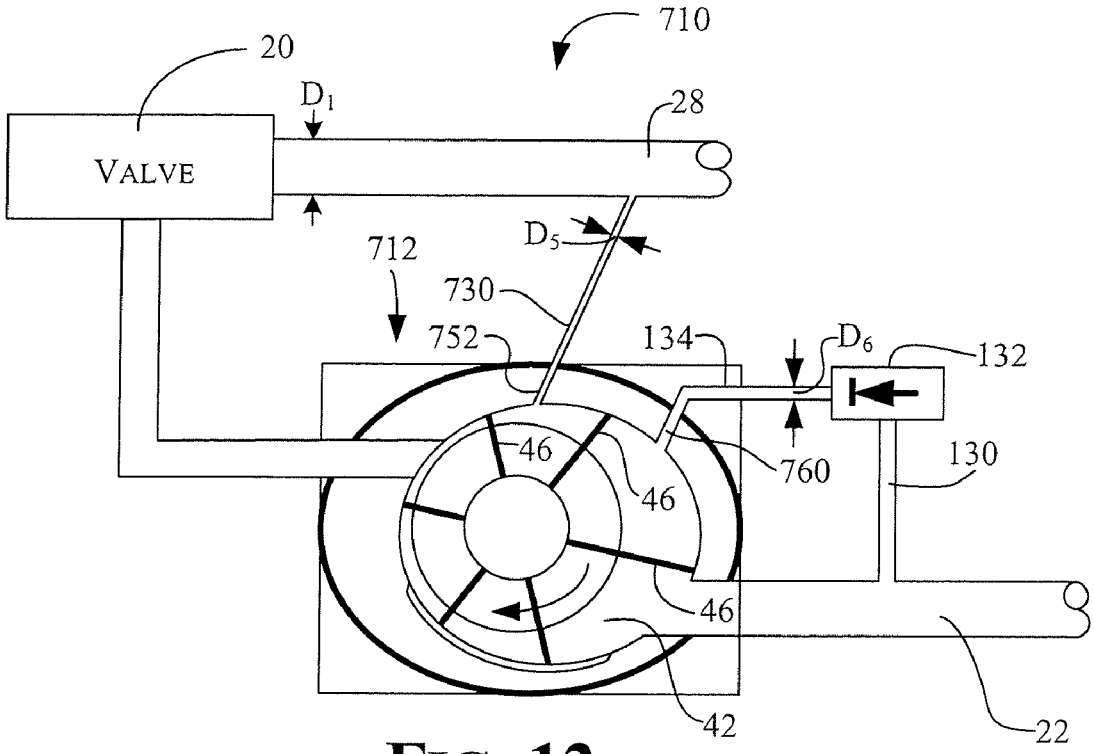
FIG. 12 is another schematic view of a portion of the air conditioning system showing the energy recovery device where high pressure refrigerant is provided to one space between adjacent pairs of the vanes and low pressure refrigerant is also provided to another space between adjacent pairs of the vanes the energy recovery device via a bypass passage to reduce suction losses when the valve is closed in accordance with the seventh embodiment of the present invention.

Referring now to FIGS. 11 and 12, an air conditioning system 710 shown in accordance with a sixth embodiment will now be explained. In view of the similarity between the various embodiments, the parts of the seventh embodiment that are identical to the parts of the earlier embodiments will be given the same reference numerals as the parts of the earlier embodiments. Moreover, the descriptions of the parts of the seventh embodiment that are identical to the parts of the earlier embodiments may be omitted for the sake of brevity. The parts of the seventh embodiment that differ from the parts of the earlier embodiments will be indicated a new reference numeral.

In the seventh embodiment as shown in FIG. 12, the air conditioning system 710 is identical to the air conditioning system 10 of the first embodiment except that the air conditioning system 710 includes a bypass line 730 that replaces the bypass line 30 of the first embodiment and the air conditioning system 710 is configured to reduce or eliminate suction losses by providing both high pressure refrigerant and low pressure refrigerant to an energy recovery device 712, as described below.

In the seventh embodiment, the energy recovery device 12 of the first embodiment is replaced with the energy recovery device 712. The energy recovery device 712 is identical to the energy recovery device 12, except for two changes. First, a first bypass port 752 replaces the bypass port 52. Second, a second bypass port 760 has been added to the energy recovery device 712. The second bypass port 760 is angularly displaced from the first bypass port 752 by a distance approximately corresponding to the angular distance between adjacent vanes 46.

The first bypass port 752 is fluidly connected to the bypass line 730 and functions generally the same way that the bypass port 52 functions when the valve 20 is closed (as described above in the first embodiment). In the seventh embodiment, the bypass line 730 and the bypass port 752 both have an internal diameter $D_5$ that is preferably the same or smaller than the internal diameter $D_2$ of the bypass line 30 of the first embodiment. More specifically, the ratio of the internal diameter $D_1$ of the high-pressure line 28 to the internal diameter $D_5$ of the bypass line 730 is preferably greater than 1:100. In other words, the ratio of the internal diameter $D_5$ of the bypass line 730 to the internal diameter the high-pressure line 28 is preferably less than 1:100.

The air conditioning system 710 also includes from the fifth embodiment the bypass pipe 130, the check valve 132 and the bypass line 134. The second bypass port 760 is fluidly connected to the bypass line 130 which feeds low pressure refrigerant from the low-pressure line 22 to the expansion chamber 42 of the energy recovery device 712. More specifically, adjacent spaces between adjacent pairs of vanes 46 of the expansion chamber of the energy recovery device 712 receive both high pressure and low pressure refrigerant when the valve 20 is closed in order to reduce or eliminate suction losses. The bypass line 730 can provide high pressure refrigerant to the energy recovery device 712 in the same manner as described above with respect to the first, second, third or fourth embodiments, only with a reduced volume due to the reduced internal diameter $D_5$ . The bypass pipe 130, the check valve 132 and the bypass line 134 can provide low pressure refrigerant the bypass passage 760 in the same manner as described above with respect to the fifth and sixth embodiments.

In this manner, the space between a first pair of adjacent vanes 46 is provided with high pressure refrigerant and an adjacent space between another pair of adjacent vanes 46 is provided with low pressure refrigerant to reduce or eliminate suction losses. It should be understood from the description and drawings that an internal diameter $D_6$ of the bypass line 134 is larger than the internal diameter $D_5$ of the bypass line 730.

It should be understood from the drawings and description herein that the configuration of the air conditioning system 710 and the energy recovery device 712 can be easily modified to include multiple bypass ports that provide high pressure refrigerant to a plurality of spaces between adjacent pairs of the vanes 46 in a manner similar to that described above in the second and third embodiments. Such increases in the number of bypass ports can be made depending upon the requirements of the overall air conditioning system and/or the overall design of the modified energy recovery device and the number of vanes provided in the modified energy recovery device. Similarly, the number of bypass ports providing low pressure refrigerant to the expansion chamber of the modified energy recovery device can likewise be increased, depending on the requirement of the system and modified energy recovery device, as mentioned above.

In each of the embodiments above that include a control unit, the control unit 32 preferably includes a microcomputer with an air conditioning system control program that controls the various embodiments of the air conditioning systems as discussed below. The control unit 32 can also include other conventional components such as an input interface circuit, an output interface circuit, and storage devices such as a ROM (Read Only Memory) device and a RAM (Random Access Memory) device. The memory circuit stores pressure and temperature parameters necessary for operation of air conditioning systems. The control unit 32 is operatively coupled to the air conditioning system components such as the valve 20 and/or the compressor 16 in a conventional manner.

It will be apparent to those skilled in the art from this disclosure that the precise structure and algorithms for the control unit 32 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The evaporator 14, the compressor 16, the condenser 18, the valve 20 and the low and high pressure lines 22, 24, 26 and 28 are conventional components that are well known in the art. Since these air conditioning components are well known in the art, these structures will not be discussed or illustrated in detail herein. Rather, it will be apparent to those skilled in the art from this disclosure that the components can be any type of structure and/or programming that can be used to carry out the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature, which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An air conditioning system comprising:

an evaporator a compressor fluidly connected to the evaporator to compress low-pressure refrigerant exiting the evaporator to high-pressure refrigerant a condenser fluidly connected to the compressor to receive the high pressure refrigerant and dissipate heat therefrom;

a valve configured to control flow of high pressure refrigerant exiting the condenser;

an energy recovery device having a chamber with an inlet fluidly connected to the valve to receive high pressure refrigerant exiting the valve and an outlet fluidly connected to the evaporator to deliver low pressure refrigerant thereto, the energy recovery device being configured to extract work from flow of refrigerant therethrough; and a bypass passage fluidly connected to the chamber of the energy recovery device downstream from the inlet of the chamber and up stream from the outlet of the chamber the bypass passage being configured to deliver an auxiliary flow of refrigerant to the chamber of the energy recovery device to reduce suction power loss such that the auxiliary flow of refrigerant exits the outlet of the chamber with the refrigerant that was received in the inlet.

2. The air conditioning system as set forth in claim 1, wherein the energy recovery device includes a second bypass passage between the bypass passage and the outlet that is also configured to receive an auxiliary flow of refrigerant to reduce suction power loss within the energy recovery device.

3. The air conditioning system as set forth in claim 1, wherein the bypass passage is configured to receive a restricted flow of high pressure refrigerant downstream from the compressor and upstream from the valve.

4. The air conditioning system as set forth in claim 1, wherein the bypass passage is configured to receive low-pressure refrigerant from a downstream section of the air conditioning system downstream from the energy recovery device.

5. The air conditioning system as set forth in claim 4, further comprising:

a check valve disposed between the bypass passage and the downstream section to regulate refrigerant flow to the bypass passage.

6. The air conditioning system as set forth in claim 1, wherein the energy recovery device is a vane type expander that includes a plurality of vanes, adjacent ones of the vanes being offset from one another by a prescribed angular distance.

7. The air conditioning system as set forth in claim 6, wherein the energy recovery device includes a plurality of bypass passages between the inlet and the outlet that are configured to receive corresponding auxiliary flows of refrigerant to reduce suction power loss within the energy recovery device.

8. The air conditioning system as set forth in claim 7, wherein the plurality of bypass passages are offset from one another within the energy recovery device by distances conforming to the angular offset between the adjacent ones of the vanes of the energy recovery device.

9. The air conditioning system as set forth in claim 1, wherein the valve is connected to a microcomputer that is further connected to at least one of a pressure sensor and a temperature sensor of the air conditioning system and is configured to control the flow of high-pressure refrigerant exiting the condenser and entering the energy recovery device.

10. The air conditioning system as set forth in claim 1, wherein the valve is connected to a relay that is further connected to a pressure sensor downstream of the energy recovery device, the relay being configured to open the valve in response to prescribed pressure conditions sensed by the pressure sensor.

11. The air conditioning system as set forth in claim 1, wherein the energy recovery device is configured to transfer work from expanding refrigerant flowing therethrough to the compressor.

12. The air conditioning system as set forth in claim 1, wherein the energy recovery device is configured to transfer work from expanding refrigerant flowing therethrough to a generator to produce electric current.

13. An air conditioning system comprising:

an evaporator;

a compressor fluidly connected to the evaporator to compress low-pressure refrigerant exiting the evaporator to high-pressure refrigerant;

a condenser fluidly connected to the compressor to receive the high pressure refrigerant and dissipate heat therefrom;

a valve configured to control flow of high pressure refrigerant exiting the condenser;

an energy recovery device having an inlet fluidly connected to the valve to receive high pressure refrigerant, an outlet fluidly connected to the evaporator to deliver low pressure refrigerant thereto, the energy recovery device being configured to extract work from flow of refrigerant therethrough;

a bypass passage downstream from the inlet and upstream from the outlet of the energy recovery device, the bypass passage being configured to deliver an auxiliary flow of refrigerant to the energy recovery device to reduce suction power loss; and a high-pressure line configured to deliver high-pressure refrigerant from the compressor to the valve and a bypass line configured to deliver high-pressure refrigerant from the high-pressure line to the bypass passage.

14. The air conditioning system as set forth in claim 13, wherein the high-pressure line has a first internal diameter and the bypass line has a second internal diameter such that the second internal diameter and the first internal diameter are dimensioned with a ratio of approximately 1:100.

15. An air conditioning system comprising:

an evaporator;

a compressor fluidly connected to the evaporator to compress low-pressure refrigerant exiting the evaporator to high-pressure refrigerant;

a condenser fluidly connected to the compressor to receive the high pressure refrigerant and dissipate heat therefrom;

a valve configured to control flow of high pressure refrigerant exiting the condenser;

an energy recovery device having an inlet fluidly connected to the valve to receive high pressure refrigerant, an outlet fluidly connected to the evaporator to deliver low pressure refrigerant thereto, the energy recovery device being configured to extract work from flow of refrigerant therethrough;

a bypass passage downstream from the inlet and upstream from the outlet of the energy recovery device, the bypass passage being configured to deliver an auxiliary flow of refrigerant to the energy recovery device to reduce suction power loss; and a low pressure line configured to deliver low pressure refrigerant from the energy recovery device to the evaporator and a bypass line configured to deliver low pressure refrigerant from the low pressure line downstream from the energy recovery device to the bypass passage.

16. The air conditioning system as set forth in claim 15, wherein the low-pressure line has a first internal diameter and the bypass line has a second internal diameter such that the first internal diameter and the second internal diameter are dimensioned with a ratio of approximately 2:1.

17. The air conditioning system as set forth in claim 1, wherein the bypass passage is configured to deliver auxiliary flow of refrigerant to the energy recovery device when the valve is closed.

18. The air conditioning system as set forth in claim 13, wherein the bypass passage is configured to deliver auxiliary flow of refrigerant to the energy recovery device when the valve is closed.

19. The air conditioning system as set forth in claim 15, wherein the bypass passage is configured to deliver auxiliary flow of refrigerant to the energy recovery device when the valve is closed.

20. The air conditioning system as set forth in claim 1, wherein the bypass passage is configured to deliver auxiliary flow of refrigerant to the energy recovery device when vapor pressure within the energy recovery device is lower than vapor pressure in a section of the air conditioning system downstream from the energy recovery device and upstream from the evaporator.

* * * * *